US010077663B2

(12) United States Patent
Malmborg et al.

(10) Patent No.: US 10,077,663 B2
(45) Date of Patent: Sep. 18, 2018

(54) GAS TURBINE ENGINE ROTOR STACK ASSEMBLY

(75) Inventors: Eric W. Malmborg, Amston, CT (US); David P. Houston, Glastonbury, CT (US); James R. Midgley, Windsor, CT (US); Robert A. Grelotti, Colchester, CT (US); Joseph W. Bridges, Durham, CT (US)

(73) Assignee: United Technologies Corporation, Farmington, CT (US)

( * ) Notice: Subject to any disclaimer, the term of this patent is extended or adjusted under 35 U.S.C. 154(b) by 2119 days.

(21) Appl. No.: 13/248,350

(22) Filed: Sep. 29, 2011

(65) Prior Publication Data

US 2013/0081406 A1 Apr. 4, 2013

(51) Int. Cl.

| | |
|---|---|
| ***F04D 29/44*** | (2006.01) |
| ***F01D 5/06*** | (2006.01) |
| *F01D 11/00* | (2006.01) |

(52) U.S. Cl.

CPC ..... *F01D 5/066* (2013.01); *F01D 11/001* (2013.01); *Y10T 29/4932* (2015.01)

(58) Field of Classification Search

CPC ..... F01D 5/066; F01D 5/084
USPC ..... 415/198.1, 199.4, 199.5; 416/201 R, 416/201 A, 198 A, 244 R, 244 A, 234
See application file for complete search history.

(56) References Cited

U.S. PATENT DOCUMENTS

| | | | | |
|---|---|---|---|---|
| 2,213,940 | A | 9/1940 | Jendrassik | |
| 2,452,782 | A | 11/1948 | McLeod et al. | |
| 2,458,149 | A | 1/1949 | Cronstedt | |
| 2,675,174 | A * | 4/1954 | Wheatley | F01D 5/06 415/190 |
| 3,976,399 | A | 8/1976 | Schmoch | |
| 5,232,339 | A | 8/1993 | Plemons et al. | |
| 5,537,814 | A * | 7/1996 | Nastuk | F01D 5/066 60/796 |
| 6,267,553 | B1 | 7/2001 | Burge | |
| 6,471,474 | B1 * | 10/2002 | Mielke | F01D 5/02 29/889.21 |
| 6,511,294 | B1 | 1/2003 | Mielke et al. | |
| 7,059,831 | B2 * | 6/2006 | Suciu | F01D 5/06 415/199.5 |
| 7,448,221 | B2 | 11/2008 | Suciu et al. | |
| 8,550,784 | B2 * | 10/2013 | Malmborg et al. | 416/198 A |

(Continued)

OTHER PUBLICATIONS

Extended European Search Report for Application No. EP 12 18 6435 dated Aug. 3, 2015.

*Primary Examiner* — Jason Shanske
*Assistant Examiner* — Jason Mikus
(74) *Attorney, Agent, or Firm* — Carlson, Gaskey & Olds

(57) ABSTRACT

A rotor stack assembly for a gas turbine engine includes a first rotor assembly and a second rotor assembly axially downstream from the first rotor assembly. The first rotor assembly and the second rotor assembly include a rim, a bore and a web that extends between the rim and the bore. A tie shaft is positioned radially inward of the bores. The tie shaft maintains a compressive load on the first rotor assembly and the second rotor assembly. The compressive load is communicated through a first load path of the first rotor assembly and a second load path of the second rotor assembly. At least one of the first load path and the second load path is radially inboard of the rims.

18 Claims, 3 Drawing Sheets

(56) References Cited

U.S. PATENT DOCUMENTS

| | | | | |
|---|---|---|---|---|
| 2003/0089226 | A1* | 5/2003 | Petin | B60T 13/563 92/169.3 |
| 2010/0124495 | A1* | 5/2010 | Bifulco | 415/216.1 |
| 2011/0052371 | A1* | 3/2011 | Aschenbruck | F01D 5/06 415/66 |
| 2011/0223026 | A1 | 9/2011 | Benjamin et al. | |

* cited by examiner

GAS TURBINE ENGINE ROTOR STACK ASSEMBLY

BACKGROUND

This disclosure relates to a gas turbine engine, and more particularly to a rotor stack assembly for a gas turbine engine.

Gas turbine engines typically include at least a compressor section, a combustor section and a turbine section. During operation, air is pressurized in the compressor section and mixed with fuel and burned in the combustor section to generate hot combustion gases. The hot combustion gases are communicated through the turbine section which extracts energy from the hot combustion gases to power the compressor section and other gas turbine engine loads.

One or more sections of the gas turbine engine may include a rotor stack assembly having a plurality of rotor assemblies that carry the airfoils or blades of successive stages of the section. A stator assembly is interspersed between each rotor assembly. The rotor assemblies of the rotor stack assembly can be held in compression in a variety of ways, including by using a tie shaft.

SUMMARY

A rotor stack assembly for a gas turbine engine includes a first rotor assembly and a second rotor assembly axially downstream from the first rotor assembly. The first rotor assembly includes a first rim, a first bore and a first web that extends between the first rim and the first bore. The second rotor assembly includes a second rim, a second bore and a second web that extends between the second rim and the second bore. A tie shaft is positioned radially inward of the first bore and the second bore. The tie shaft maintains a compressive load on the first rotor assembly and the second rotor assembly. The compressive load is communicated through a first load path of the first rotor assembly and a second load path of the second rotor assembly. At least one of the first load path and the second load path is radially inboard of the first rim and the second rim.

In another exemplary embodiment, a gas turbine engine includes a compressor section, a combustor section and a turbine section each disposed about an engine centerline axis. A rotor stack assembly is disposed within at least one of the compressor section and the turbine section. The rotor stack assembly includes at least a first rotor assembly and a second rotor assembly downstream from the first rotor assembly. A tie shaft is positioned radially inward of the first rotor assembly and the second rotor assembly and maintains a compressive load on the first rotor assembly and the second rotor assembly. The compressive load is communicated through the first rotor assembly along a first load path and through the second rotor assembly along a second load path. The first rotor assembly includes a first radial gap establishing a first distance between a first rim and the first load path of the first rotor assembly and the second rotor assembly includes a second radial gap establishing a second distance between a second rim and the second load path of the second rotor assembly. The second distance is greater than the first distance.

In yet another exemplary embodiment, a method for providing a rotor stack assembly for a gas turbine engine includes lowering a load path of a rotor assembly of the rotor stack assembly. A rim of the rotor assembly is isolated from a primary gas path of the gas turbine engine.

The various features and advantages of this disclosure will become apparent to those skilled in the art from the following detailed description. The drawings that accompany the detailed description can be briefly described as follows.

DETAILED DESCRIPTION

Figure 1:
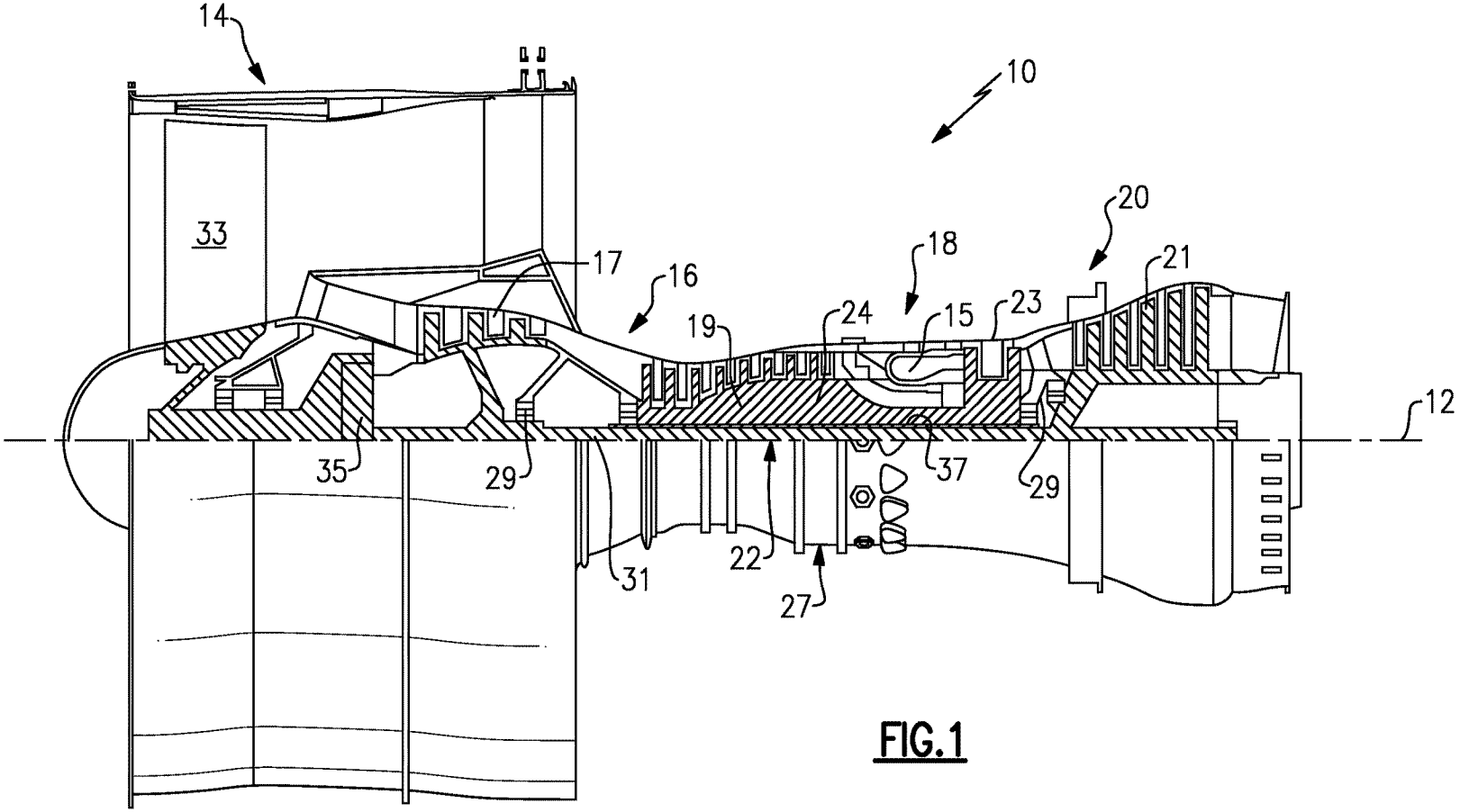
FIG. 1 illustrates a cross-sectional view of a gas turbine engine.

FIG. 1 schematically illustrates a gas turbine engine 10. The example gas turbine engine 10 is a two spool turbofan engine that generally incorporates a fan section 14, a compressor section 16, a combustor section 18 and a turbine section 20. Alternative engines might include fewer or additional sections such as an augmenter section (not shown) among other systems or features. Generally, the fan section 14 drives air along a bypass flow path, while the compressor section 16 drives air along a core flow path for compression and communication into the combustor section 18. The hot combustion gases generated in the combustor section 18 are expanded through the turbine section 20. This view is highly schematic and is included to provide a basic understanding of the gas turbine engine 10 and not to limit the disclosure. This disclosure extends to all types of gas turbine engines and to all types of applications.

The gas turbine engine 10 generally includes at least a low speed spool 22 and a high speed spool 24 mounted for rotation about an engine centerline axis 12 relative to an engine static structure 27 via several bearing systems 29. The low speed spool 22 generally includes an inner shaft 31 that interconnects a fan 33, a low pressure compressor 17, and a low pressure turbine 21. The inner shaft 31 can connect to the fan 33 through a geared architecture 35 to drive the fan 33 at a lower speed than the low speed spool 22. The high speed spool 24 includes an outer shaft 37 that interconnects a high pressure compressor 19 and a high pressure turbine 23.

A combustor 15 is arranged between the high pressure compressor 19 and the high pressure turbine 23. The inner shaft 31 and the outer shaft 37 are concentric and rotate about the engine centerline axis 12. A core airflow is compressed by the low pressure compressor 17 and the high pressure compressor 19, is mixed with fuel and burned within the combustor 15, and is then expanded over the high pressure turbine 23 and the low pressure turbine 21. The turbines 21, 23 rotationally drive the low speed spool 22 and the high speed spool 24 in response to the expansion.

Figure 2:
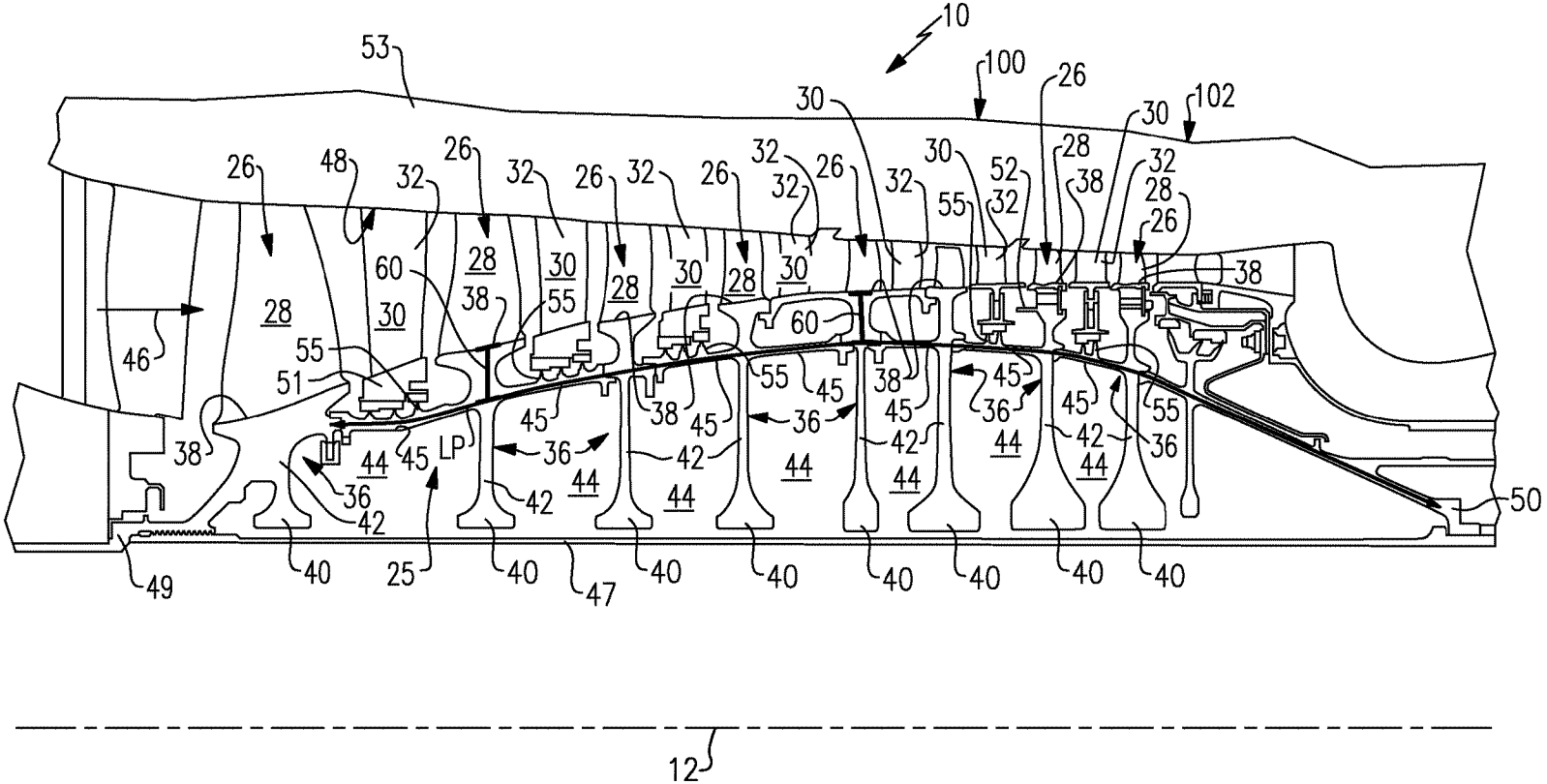
FIG. 2 illustrates a cross-sectional view of a portion of the gas turbine engine.

FIG. 2 illustrates a portion 100 of a gas turbine engine 10. In this example, the illustrated portion is the high pressure compressor 19 of the gas turbine engine 10. However, this disclosure is not limited to the high pressure compressor 19, and could extend to other sections of the gas turbine engine 10.

In this example, the portion 100 of the gas turbine engine 10 includes a rotor stack assembly 25. The rotor stack assembly 25 is composed of a plurality of rotor assemblies 26 that are circumferentially disposed about the engine centerline axis 12. Vane assemblies 30 having at least one stator vane 32 are interspersed axially between the rotor assemblies 26. Although depicted with a specific number of stages, the portion 100 could include fewer or additional stages.

Each rotor assembly 26 includes one or more rotor airfoils (or blades) 28 and a rotor disk 36. The rotor disks 36 carry the rotor airfoils 28 and are rotatable about the engine centerline axis 12 to rotate the rotor airfoils 28. Each rotor disk 36 includes a rim 38, a bore 40 and a web 42 that extends between the rim 38 and the bore 40. A plurality of cavities 44 extend between adjacent rotor disks 36. The cavities 44 are radially inward from the airfoils 28 and the stator vanes 32. A plurality of spacers 45 can extend between adjacent rotor disks 36. The plurality of spacers 45 can include sealing mechanisms 55 that seal the cavities 44 as well as the inner diameters of the stator vanes 32.

A primary gas path 46 for directing a stream of core airflow axially in an annular flow is generally defined by the multiples stages of rotor assemblies 26 and the vane assemblies 30. Each stage of the portion 100 includes one rotor assembly 26 and one vane assembly 30. The primary gas path 46 extends radially between an inner wall 48 of an engine casing 53 and the rims 38 of the rotor disks 36, as well as inner platforms 51 of the vane assemblies 30. The temperature of the primary gas path 46 generally increases as the primary gas path is communicated downstream (i.e., the temperature increases in each successive stage of the portion 100).

The rotor stack assembly 25 can also define a secondary gas path 52 that is generally radially inward from the primary gas path 46. A conditioned airflow, such as a cooled, heated or pressurized airflow, can be communicated through the secondary gas path 52 to condition specific areas of the rotor stack assembly 25, such as the rotor assemblies 26.

A tie shaft 47 extends through the rotor stack assembly 25 on a radially inner side of the bores 40. The tie shaft 47 can be preloaded to maintain a compressive load on the rotor assemblies 26 of the rotor stack assembly 25. The tie shaft 47 extends between a forward hub 49 and an aft hub 50. The tie shaft 47 can be threaded through the forward hub 49 and snapped into the rotor disk 36 of the final stage of the portion 100. Once connected between the forward hub 49 and the aft hub 50, the preloaded tension on the tie shaft 47 can be maintained by a nut or other mechanisms.

The tie shaft 47 maintains a compressive load on the rotor stack assembly 25. The compressive load is communicated along a load path that extends through the "backbone" of the rotor stack assembly 25. The load path is indicated by the solid line LP of FIG. 2, and can be communicated through the spacers 45 that extend between adjacent rotor disks 36. A radial gap 60 extends between the rims 38 and the load path LP of each rotor disk 36.

The load paths of at least a portion of the rotor disks 36 of the rotor stack assembly 25 are radially inboard from the rims 38 of the rotor assemblies 26, as is further discussed below. That is, the load path is generally lowered through at least a portion of the rotor stack assembly 25. In addition, the rotor assemblies 26 positioned in at least an aft portion 102 of the rotor stack assembly 25 can be bladed rotor assemblies, as is also discussed in greater detail below.

Figure 3:
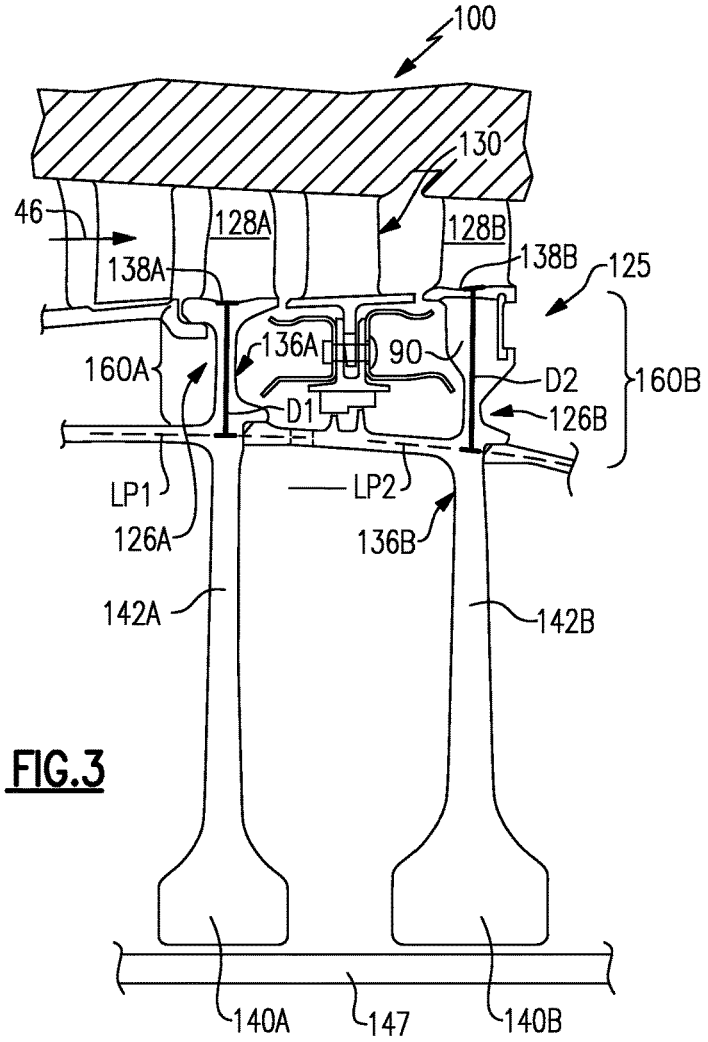
FIG. 3 illustrates an example rotor stack assembly.

FIG. 3 illustrates an exemplary rotor stack assembly 125 having a first rotor assembly 126A and a second rotor assembly 126B that is positioned axially downstream (i.e., aft) from the first rotor assembly 126A. Although two rotor assemblies 126A, 126B are illustrated, it should be understood that the rotor stack assembly 125 could include fewer or additional rotor assemblies. A vane assembly 130 is interspersed between the first rotor assembly 126A and the second rotor assembly 126B.

The first rotor assembly 126A includes a first rotor airfoil 128A and a first rotor disk 136A including a first rim 138A, a first bore 140A and a first web 142A that extends between the first rim 138A and the first bore 140A. Likewise, the second rotor assembly 126B includes a first rotor airfoil 128B and a second rotor disk 136B that includes a second rim 138B, a second bore 140B and a second web 142B that extends between the second rim 138B and the second bore 140B. In this example, the first rotor assembly 126A includes integrally bladed airfoils 128A of a single-piece construction (i.e., monolithic structures) and the second rotor assembly 126B includes airfoils 128B that are bladed (i.e., the airfoils 128B are separate structures from the second rotor disk 136B).

Figure 4:
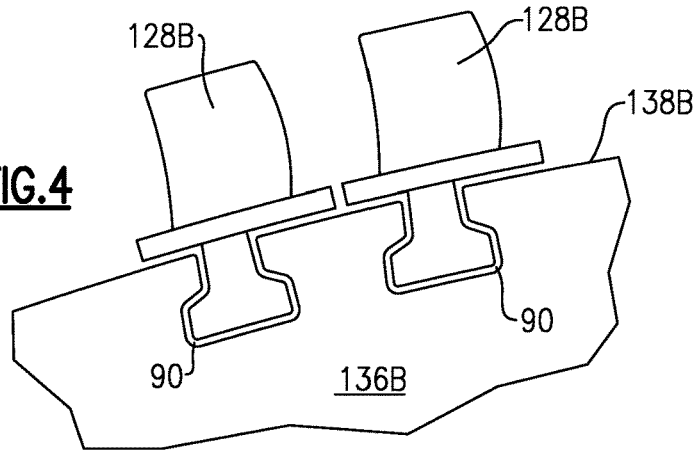
FIG. 4 illustrates a bladed rotor assembly of a rotor stack assembly.

For example, the airfoils 128B of the second rotor assembly 126B can be received and carried by a plurality of slots 90 that extend through the rim 138B of the second rotor assembly 126B (See FIG. 4). In this way, the second rim 138B of the second rotor assembly 126B is substantially isolated from the primary gas path 46, i.e., the second rim 138B is positioned below, or radially inward, relative to the interface between the slots 90 and the airfoils 128B.

A tie shaft 147 maintains a compressive load through the first rotor assembly 126A and the second rotors assembly 126B. This compressive load is communicated through a first load path LP1 of the first rotor assembly 126A and a second load path LP2 of the second rotor assembly 126B. In this example, the first load path LP1 and second load path LP2 are radially inboard from the rims 138A and 138B, respectively. The load paths LP1 and LP2 extend through a portion of the webs 142A, 142B, in this example.

A first radial gap 160A establishes a first distance D1 between the first rim 138A and the first load path LP1. A second radial gap 160B similarly establishes a second distance D2 between the second rim 138B and the second load path LP2. The second distance D2 is a greater distance than the first distance Dl. Therefore, the second load path LP2 of the second rotor assembly 126B extends radially inboard from the first load path LP1 of the first rotor assembly 126A. The rim 138B of the second rotor assembly 126B is therefore substantially thermally isolated from the primary gas path 46, thereby improving thermal mechanical fatigue characteristics of the rotor assembly 126B.

The second rotor assembly 126B of this example is illustrated as rotor assembly of the final stage of the portion 100 of the gas turbine engine 10. However, it should be understood that a rotor assembly having a lowered load path such as illustrated by the rotor assembly 126B can be provided in additional stages of the portion 100. For example, the final two stages (or additional stages) of the high pressure compressor 19 of the gas turbine engine 10 can include a rotor assembly having a reduced load path (see FIG. 2). Generally, the radial gap associated with each rotor assembly 126A, 126B (in at least the portion 100 of the gas turbine engine 10) can increase as the temperature increases with each successive stage of the rotor stack assembly 125 in the primary gas path 46.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A rotor stack assembly for a gas turbine engine, comprising:

a first rotor assembly having a first rim, a first bore and a first web that extends between said first rim and said first bore;

a second rotor assembly aft of said first rotor assembly and having a second rim, a second bore and a second web that extends between said second rim and said second bore, at least one of said first rotor assembly and said second rotor assembly including a rotor blade that extends radially outboard of said first rim or said second rim;

a tie shaft positioned radially inward of said first bore and said second bore, wherein said tie shaft maintains a compressive load on said first rotor assembly and said second rotor assembly, said tie shaft threaded through a forward hub and snapped into an aft hub; and said compressive load is communicated through a first load path of said first rotor assembly and a second load path of said second rotor assembly, wherein at least one of said first load path and said second load path is radially inboard of said first rim and said second rim.

2. The assembly as recited in claim 1, comprising a spacer that extends between said first rotor assembly and said second rotor assembly.

3. The assembly as recited in claim 2, wherein said compressive load is communicated through said spacer.

4. The assembly as recited in claim 1, wherein at least one of said first rotor assembly and said second rotor assembly is a bladed rotor assembly.

5. The assembly as recited in claim 4, wherein said bladed rotor assembly includes a blade received in a slot of one of said first rim and said second rim.

6. The assembly as recited in claim 5, wherein at least one of said first load path and said second load path are radially inboard of said slot.

7. A gas turbine engine, comprising:

a compressor section, a combustor section and a turbine section each disposed about an engine centerline axis;

a rotor stack assembly disposed within at least one of said compressor section and said turbine section, said rotor stack assembly including at least a first rotor assembly and a second rotor assembly downstream from said first rotor assembly;

a tie shaft positioned radially inward of said first rotor assembly and said second rotor assembly and that maintains a compressive load on said first rotor assembly and said second rotor assembly, wherein said compressive load is communicated through said first rotor assembly along a first load path and through said second rotor assembly along a second load path; and wherein said first rotor assembly includes a first radial gap establishing a first distance between a first rim and said first load path of said first rotor assembly and said second rotor assembly includes a second radial gap establishing a second distance between a second rim and said second load path of said second rotor assembly, wherein said second distance is greater than said first distance.

8. The gas turbine engine as recited in claim 7, wherein at least one of said first rotor assembly and said second rotor assembly is a bladed rotor assembly.

9. The gas turbine engine as recited in claim 8, wherein said bladed rotor assembly includes a blade received in a slot of one of said first rim and said second rim.

10. The gas turbine engine as recited in claim 9, wherein at least one of said first load path and said second load path are radially inboard of said slot.

11. The gas turbine engine as recited in claim 7, comprising a spacer that extends between said first rotor assembly and said second rotor assembly.

12. The gas turbine engine as recited in claim 11, wherein said compressive load is communicated through said spacer.

13. The gas turbine engine as recited in claim 7, wherein said first load path and said second load path are isolated from said first rim and said second rim of said first rotor assembly and said second rotor assembly.

14. The gas turbine engine as recited in claim 7, comprising a primary gas path that extends between an outer casing and said first rim of said first rotor assembly and said second rim of said second rotor assembly, wherein a second temperature of said primary gas path at said second rim is greater than a first temperature of said primary gas path at said first rim.

15. A method for providing a rotor stack assembly for a gas turbine engine, comprising the steps of:

lowering a load path of a rotor assembly of the rotor stack assembly including establishing a radial gap having a first distance between a rim and the load path of the rotor assembly, wherein the radial gap is greater than a second radial gap of an upstream rotor assembly; and isolating the rim of the rotor assembly from a primary gas path of the gas turbine engine, the rotor assembly including a rotor blade that extends radially outboard of the rim.

16. The method as recited in claim 15, wherein the load path is radially inboard from the rim.

17. The method as recited in claim 15, wherein the step of isolating the rim includes:

inserting the rotor blade into a slot of the rim.

18. The assembly as recited in claim 1, comprising a first airfoil configured as an integrally bladed airfoil of said first rotor assembly and a second airfoil received within a slot of said second rim of said second rotor assembly.

* * * * *